United States Patent [19]

Ooi et al.

[11] Patent Number: 5,057,803

[45] Date of Patent: Oct. 15, 1991

[54] STRIPLINE SPLIT RING RESONATOR BANDPASS FILTER

[75] Inventors: Leng H. Ooi; Peter J. Yeh, both of Sunrise; Branko Avanic, Coral Gables, all of Fla.

[73] Assignee: Motorola, Inc., Schaumburg, Ill.

[21] Appl. No.: 561,117

[22] Filed: Aug. 1, 1990

[51] Int. Cl.[5] ..... H01P 1/203; H01P 7/08

[52] U.S. Cl. ..... 333/204; 333/219; 455/339

[58] Field of Search ..... 333/202, 204, 205, 219, 333/246; 455/307-314, 286, 339

[56] References Cited

U.S. PATENT DOCUMENTS

| | | | |
|---|---|---|---|
| 2,608,648 | 8/1952 | Magnuski | 455/286 X |
| 3,805,198 | 4/1974 | Gewartowski et al. | 333/219 X |
| 4,406,019 | 9/1983 | Ide et al. | 455/339 X |
| 4,829,594 | 5/1989 | Heck et al. | 455/312 X |

FOREIGN PATENT DOCUMENTS

| | | | |
|---|---|---|---|
| 0179201 | 8/1987 | Japan | 333/219 |
| 0286003 | 11/1988 | Japan | 333/204 |

OTHER PUBLICATIONS

Makimoto et al., Varactor Tuned Bandpass Filters Using Microstrip-Line Ring Resonators, *IEEE MTT-S Digest* (1986), at pp. 411-414.

*Primary Examiner*—Eugene R. Laroche
*Assistant Examiner*—Seung Ham
*Attorney, Agent, or Firm*—Michael J. Buchenhorner

[57] ABSTRACT

A stripline split-ring resonator bandpass filter comprises first and second conducting layers and first and second substrates connected to each other between the conducting layers. A first stripline ring resonator is located on the top side of the second nonconducting substrate and is coupled to the input port of the BPF. The first stripline ring resonator has a gap located therein. A second stripline ring resonator is also located on the top side of the second nonconducting substrate between the first stripline ring resonator and the output port of the BPF. The second stripline ring resonator has a gap located therein. The first substrate has at least two slots therein to allow lumped capacitors to be placed in the gaps in the first and second ring resonators.

6 Claims, 3 Drawing Sheets

STRIPLINE SPLIT RING RESONATOR BANDPASS FILTER

TECHNICAL FIELD

This invention relates generally to bandpass (BPFs) filters and more specifically to stripline BPFs using split ring resonators.

BACKGROUND

Conventional split-ring resonator BPFs enjoy the advantage of operation at high frequencies (e.g., in the gigahertz range) without being substantially affected by the proximity of parasitic components. Additionally, split-ring resonators have considerably less radiation losses than do straight microstrip resonators, thus enabling the use of microstrip technology in the implementation of BPFs. The use of stripline structure for this type of resonator would substantially eliminate small radiation losses associated with microstrip structure.

SUMMARY OF THE INVENTION

Accordingly, it is an object of the present invention to overcome the detriments of the prior art.

Briefly, according to the invention, a stripline split-ring resonator bandpass filter comprises first and second conducting layers and first and second substrates connected to each other between the conducting layers. A first stripline ring resonator is located on the top side of the second nonconducting substrate and is coupled to the input port of the BPF. The first stripline ring resonator has a gap located therein. A second stripline ring resonator is also located on the top side of the second nonconducting substrate between the first stripline ring resonator and the output port of the BPF. The second stripline ring resonator has a gap located therein. The first substrate has at least two slots therein to allow lumped capacitors to be placed in the gaps in the first and second ring resonators.

DETAILED DESCRIPTION OF THE PREFERRED EMBODIMENT

Figure 1:
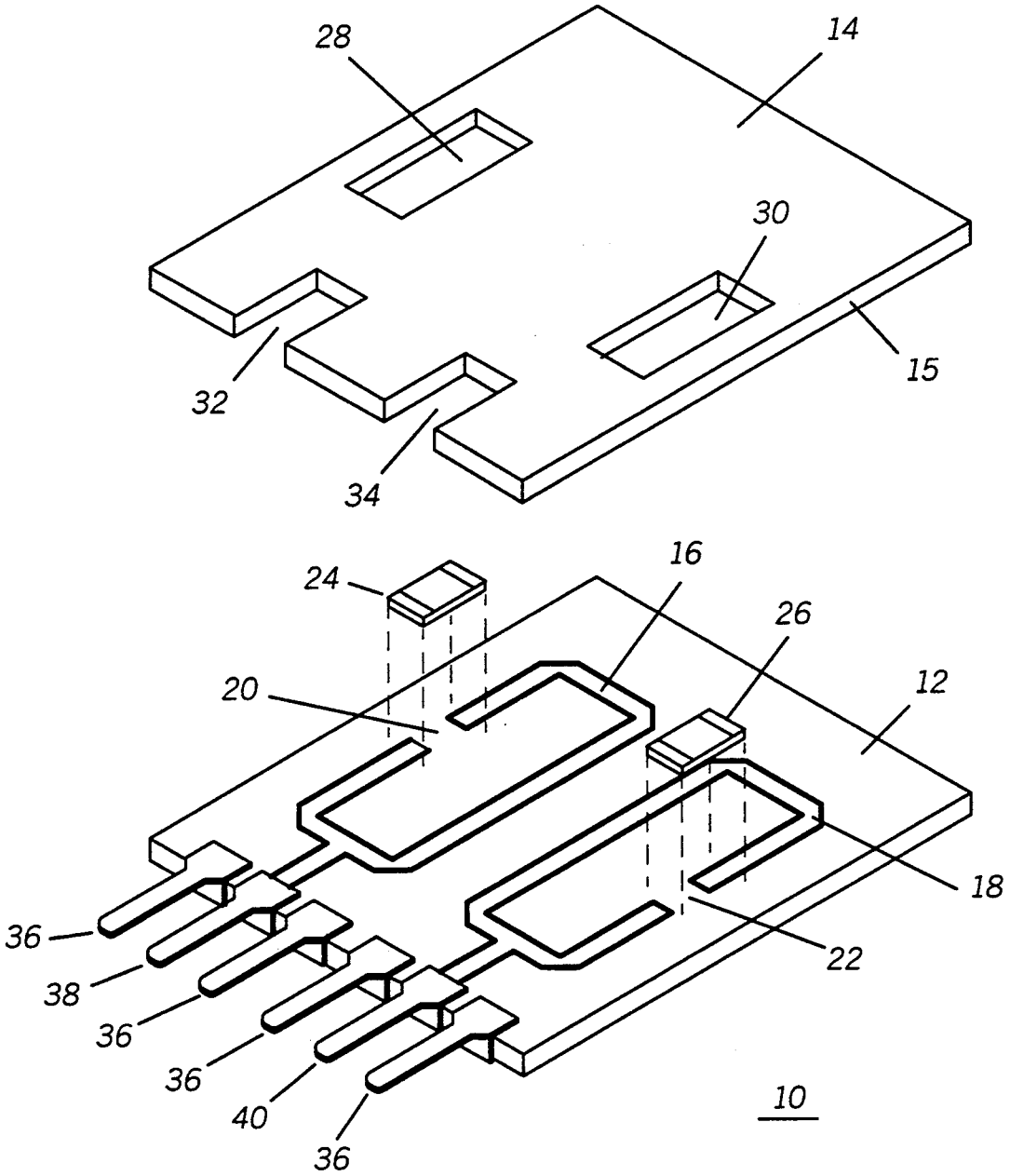
FIG. 1 is an exploded view of a stripline split-ring resonator BPF in accordance with the invention.

Referring to FIG. 1, an exploded view of a BPF 10 in accordance with the invention is shown. The BPF 10 comprises a top conducting layer 14 located (preferably plated) on a first nonconducting substrate (e.g., a ceramic substrate) 15. The top conducting layer 14 is to be connected to ground potential. Two preferably rectangular slots 28 and 30 are made through the top conducting layer 14 and the first nonconducting substrate 15. A pair of slots 32 and 34 may also be made on the top conducting layer 14 and the first nonconducting substrate 15 to accomodate connectors to the BPF.

A first split-ring resonator 16 is plated on a second nonconducting substrate 12. The first split-ring resonator is connected to the input 38 to the BPF 10 and has a gap 20 therein. A second split-ring resonator 18 (also having a gap 22 therein) is also plated on the second nonconducting substrate 12. The second split-ring resonator 18 is connected to the output 40, and electromagnetically coupled to the first split-ring resonator 16. A bottom conducting layer (not shown) is plated on the bottom of the second nonconducting substrate 12 and is connected to ground potential through connectors 36. The gaps 20 and 22 are located in the split-ring resonators 16 and 18, respectively, so as to coincide with the slots 28 and 30, respectively.

A first chip capacitor (or lumped capacitance) 24 is connected across the gap 20, and a second chip capacitor 26 is connected across the gap 22. The introduction of these capacitances into the gaps in the resonators accomplishes size reduction. This is easily accomplished using microstrip technology but such is not the case in stripline technology. Thus, the slots 28 and 30 are used to allow the drop-in placement of the capacitors 24 and 26. The assembly of the BPF 10 is essentially completed by attaching the first nonconducting substrate 15 to the second nonconducting substrate 12. To facilitate this assembly, split-ring resonators (not shown), that are the mirror images of the split-ring resonators 16 and 18, may be located on the bottom side of the substate 15, so that the resonators 16 and 18 may be soldered to their corresponding mirror-image resonators.

Figure 2:
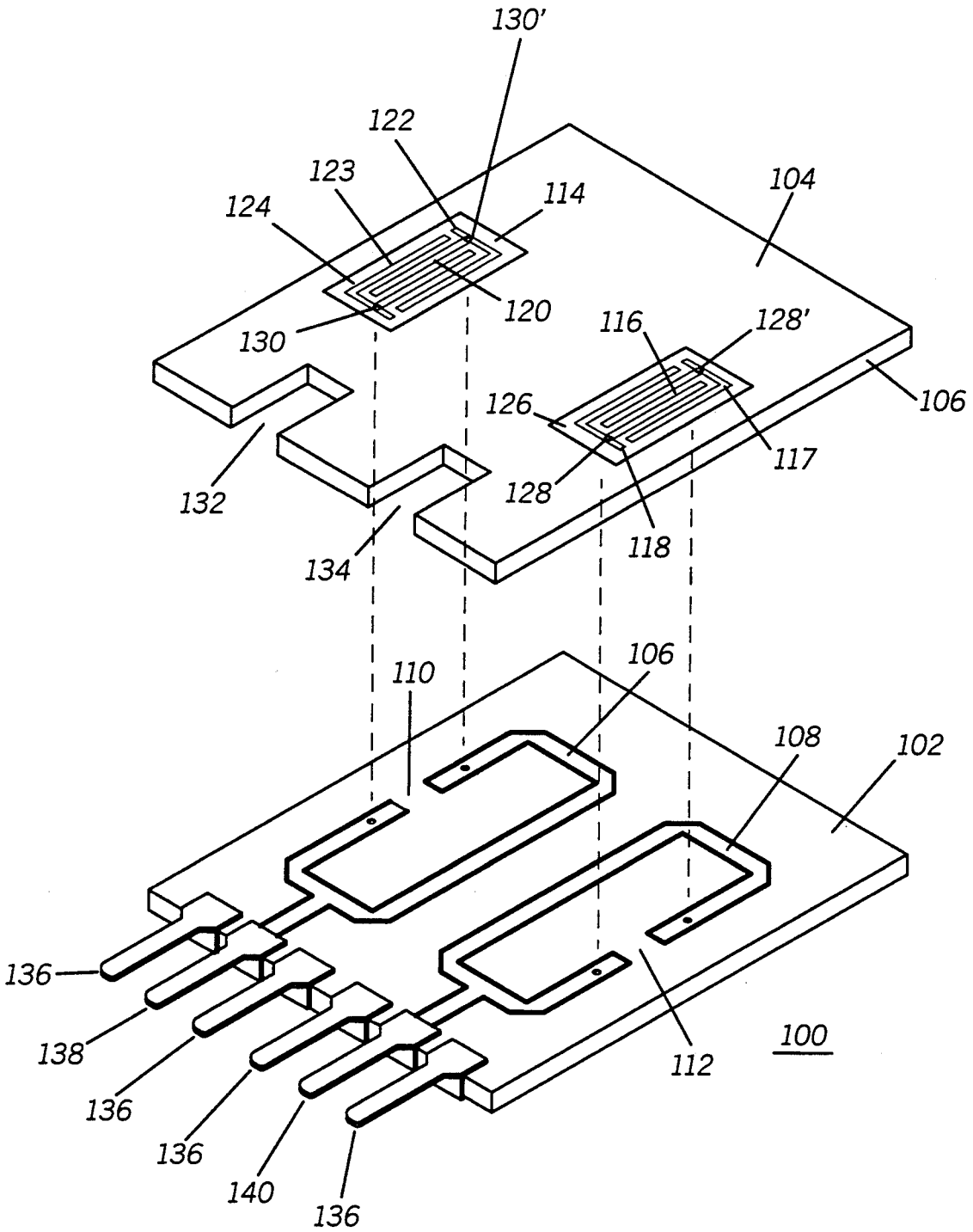
FIG. 2 is an exploded view of another stripline split-ring resonator BPF in accordance with the invention.

Referring to FIG. 2, an exploded view of another BPF 100 using interdigital capacitors in accordance with the invention is shown. The BPF 100 comprises a top conducting layer 104 located (preferably plated) on a first nonconducting substrate (e.g., a ceramic substrate) 106. The top conducting layer 104 is to be connected to ground potential. Two preferably rectangular slots 114 and 126 are made through the top conducting layer 104 and a pair of distributed capacitances 120 and 116 are located in the slots 124 and 126, respectively, on the first nonconducting substrate 106. A pair of slots 132 and 134 may also be made on the top conducting layer 104 and the first nonconducting substrate 106 to accommodate connectors to the BPF.

A first split-ring resonator 106 is plated on a second nonconducting substrate 102. The first split-ring resonator 106 is connected to the input 138 to the BPF 100 and has a gap 110 therein. A second split-ring resonator 108 (also having a gap 112 therein) is also plated on the second nonconducting substrate 102. The second split-ring resonator 108 is connected to the output 140, and electromagnetically coupled to the first split-ring resonator 106. A bottom conducting layer (not shown) is plated on the bottom of the second nonconducting substrate 102 and is connected to ground potential through connectors 136. The gaps 110 and 112 are located in the split-ring resonators 106 and 108, respectively, so as to coincide with the slots 124 and 126, respectively.

A first distributed capacitance 120 is connected across the gap 110, and a second distributed capacitance 116 is connected across the gap 112. The first distributed capacitance 120 comprises a first plate 122 and a second plate 123. The first plate 122 is connected to the ring resonator 106 at one end of the gap 110 (through a hole 130'), and the second plate 123 is connected to the ring resonator 106 at the other end of the gap 110 (through a hole 130). Similarly, the second distributed capacitance 116 comprises a first plate 117 and a second plate 118. The first plate 117 is connected to the ring resonator 108 at one end of the gap 110 (through a hole 128'), and the second plate 118 is connected to the ring resonator 108 at the other end of the gap 112 (through a hole 128). The assembly of the BPF 100 is essentially completed by attaching the first nonconducting substrate 106 to the second nonconducting substrate 102.

Figure 3:
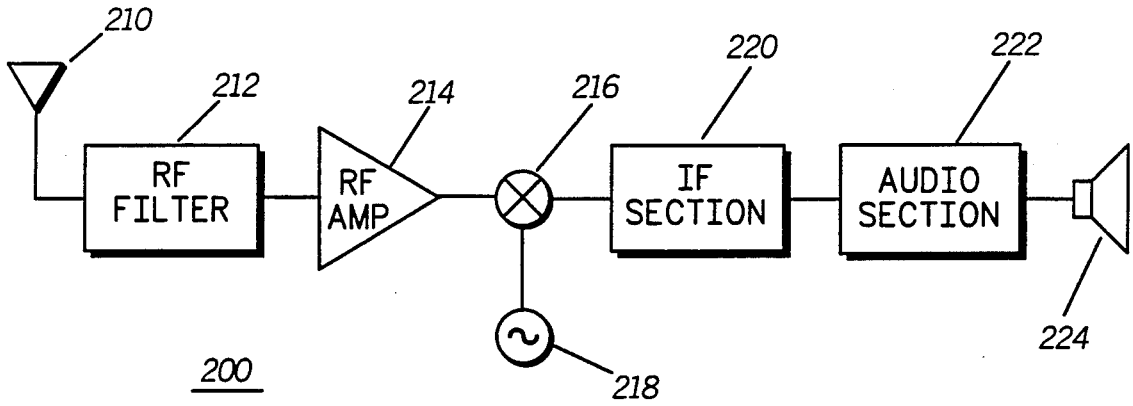
FIG. 3 shows a radio receiver in accordance with the invention.

Referring to FIG. 3, a radio 200 is shown incorporating the RF filter 212 in accordance with the invention. A radio-frequency signal is received at a conventional antenna 210 and filtered by the BPF 212 before amplification by a conventional RF amplifier 214. The amplified signal provided by the RF amplifier 214 is then mixed with a reference signal provided by a conventional local oscillator 218 to produce an intermediate frequency (IF) signal. The IF signal is then applied to a conventional IF section 220 where it is processed and demodulated to produce an audio signal. The audio signal is then applied to a conventional audio section 222 and presented to a listener by a conventional speaker 224.

Employing the BPF 212 in such an application improves the performance of the radio 200. However, it will be appreciated that the invention may be advantageously used in other RF parts of radio receivers or transmitters.

What is claimed is:

1. A stripline bandpass filter, having an input port and an output port, comprising:

a first conducting layer;

a first nonconducting substrate, having a top side and a bottom side, the top side being attached to the first conducting layer, the first nonconducting substrate also having at least first, second, third, and fourth holes therein;

a second nonconducting substrate, having a top side and a bottom side, the top side being attached to the bottom side of the first nonconducting substrate;

a first stripline ring resonator, located on the top side of the second nonconducting substrate and coupled to the input port, the first stripline ring resonator having a gap located therein;

a second stripline ring resonator, located on the top side of the second nonconducting substrate and coupled to the first stripline ring resonator and to the output port, the second stripline ring resonator having a gap located therein;

a first distributed capacitance located on the first nonconducting substrate, the first capacitance being connected across the first gap through the first and second holes; and a second distributed capacitance located on the first nonconducting substrate, the second capacitance having being connected across the second gap through the third and fourth holes.

2. The bandpass filter of claim 1, wherein the first and second distributed capacitances comprise finger portions.

3. The bandpass filter of claim 1, wherein the first and second nonconducting substrates comprise a ceramic material.

4. A communication device comprising:

receiver means for receiving a modulated signal;

detector means for demodulating the modulated signal, to produce a demodulated signal;

presenting means for presenting the demodulated signal to a user of the communication device;

the receiver means comprising a bandpass filter, having an input port and an output port, comprising:

a first conducting layer;

a first nonconducting substrate, having a top side and a bottom side, the top side being attached to the first conducting layer, the first nonconducting substrate also having at least first, second, third, and fourth holes therein;

a second nonconducting substrate, having a top side and a bottom side, the top side being attached to the bottom side of the first nonconducting substrate;

a first stripline ring resonator, located on the top side of the second nonconducting substrate and coupled to the input port, the first stripline ring resonator having a gap located therein;

a second stripline ring resonator, located on the top side of the second nonconducting substrate coupled to the first stripline ring resonator and to the output port, the second stripline ring resonator having a gap located therein;

a first distributed capacitance located on the first nonconducting substrate, the first capacitance having being connected across the first gap; and a second distributed capacitance located on the first nonconducting substrate, the second capacitance having being connected across the second gap.

5. The communication device of claim 4, wherein the first and second distributed capacitances comprise finger portions.

6. The communication device of claim 4, wherein the first and second nonconducting substrates comprise a ceramic material.

* * * * *